United States Patent [19]

Story et al.

[11] Patent Number: 5,062,770

[45] Date of Patent: Nov. 5, 1991

[54] FLUID PUMPING APPARATUS AND SYSTEM WITH LEAK DETECTION AND CONTAINMENT

[75] Inventors: Carl E. Story, Cupertino; Jerry A. Nichols, San Jose; Byron C. Cady, Gilroy, all of Calif.

[73] Assignee: Systems Chemistry, Inc., Milpitas, Calif.

[21] Appl. No.: 393,142

[22] Filed: Aug. 11, 1989

[51] Int. Cl.[5] ..... F04B 43/06

[52] U.S. Cl. ..... 417/46; 417/63; 417/375; 417/395; 92/100; 92/103 SD

[58] Field of Search ..... 417/395, 375, 63, 46; 92/103 SD, 100

[56] References Cited

U.S. PATENT DOCUMENTS

| | | | |
|---|---|---|---|
| 2,239,270 | 4/1941 | Jahreis | 417/9 |
| 2,625,886 | 1/1953 | Browne | 417/63 |
| 3,131,638 | 5/1964 | Wilson et al. | 417/388 |
| 3,176,623 | 4/1965 | Howerton et al. | 417/9 |
| 3,410,263 | 11/1968 | McGinnis | 417/375 |
| 3,546,691 | 12/1970 | Smith | 417/63 |
| 3,606,592 | 9/1971 | Madurski et al. | 92/103 F |
| 3,807,906 | 4/1974 | Breit | 417/63 |
| 4,740,139 | 4/1988 | Mantell | 92/5 R |
| 4,778,356 | 10/1988 | Hicks | 417/397 |

*Primary Examiner*—Leonard E. Smith
*Assistant Examiner*—David W. Scheuermann
*Attorney, Agent, or Firm*—Rosenblum, Parish & Bacigalupi

[57] ABSTRACT

A fluid pumping apparatus and system including a double acting diaphragm pumping device in which each pumping component has a pair of spaced apart diaphragms defining a containment chamber and all exposed surfaces in the pumping chamber and the containment chamber are made of an inert plastic material, a fluid sensor extending into each containment chamber for sensing the presence of unwanted fluids therein, and a pump control system for activating the pumping apparatus and responding to an output signal generated by either sensor to deactivate the pumping apparatus in the event of leakage of fluid into either containment chamber.

18 Claims, 3 Drawing Sheets

FLUID PUMPING APPARATUS AND SYSTEM WITH LEAK DETECTION AND CONTAINMENT

BACKGROUND OF THE INVENTION

1. Field of the Invention

The present invention relates generally to fluid pumping apparatus and more particularly to an improved pumping system including a double acting pump having dual diaphragm pumping chambers with leak detector means.

2. Brief Description of the Prior Art

In the semiconductor manufacturing industry, various corrosive and caustic materials are used and must be carefully handled to prevent damage to mechanical equipment and injury to both environment and production employees. Futhermore, processing chemicals, solvents and deionized water must be kept as pure as possible during all aspects of their handling and supply since any contact of the flow stream with a contaminant can result in defects in the manufactured product, such defects often being undetectable until after the manufacturing operation has been completed. In order to prevent such damage and injury, and contamination of the processing fluids, attempts have been made to provide apparatus in which all fluid wetted surfaces are made of or coated with an inert plastic. For example, the double diaphragm reciprocating pump manufactured by the American Pump Company, Inc. of Springfield, Mass. has most of its parts made of solid Teflon ® or polypropoline and is powered by compressed air which alternately pressurizes the inner side of one diaphragm of a first single diaphragm chamber while simultaneously exhausting the inner chamber of a second single diaphragm chamber. The two diaphragms are connected by a common rod, such that when the inner side of one diaphragm chamber is pressurized to move the diaphragm outward on its discharge stroke, the opposite diaphragm is pulled inward on its suction stroke. As the diaphragms approach the end of a stroke, an air switch shifts compressed air to the opposite chamber and discharges the one it was previously feeding. This reciprocating movement of diaphragms creates an alternating suction and discharge action in each outer diaphragm chamber.

Although this design approach appears to provide a workable solution to the problem in the first instance, it does not address the problem of preventing process fluid contamination in the event of the failure of a diaphragm or other sealing part within the apparatus used to pump the fluid through the processing system.

SUMMARY OF THE PRESENT INVENTION

It is therefore a principal object of the present invention to provide a fluid pumping apparatus having means for preventing contamination of the pumped fluid in the event of a pump failure.

Another object of the present invention is to provide an improved double acting pump having all wetted surfaces made of a chemically inert material and having means for preventing contact of the pumped fluid with any contaminating surface within the pump in the event of a seal failure.

Still another object of the present invention is to provide a double acting diaphragm pump of the type described having dual diaphragms in each pumping component spaced apart to provide a containment chamber isolating the pumping chamber from the driving mechanism.

Yet another object of the present invention is to provide a device of the type described having means for quickly sensing the intrusion of fluid into the containment chamber.

Another object of the present invention is to provide a pumping system, including a pump of the type described having means responsive to sensors disposed in containment chambers for deactivating the pumping device in the event that fluid is detected in either containment chamber.

Briefly, a preferred embodiment of the present invention includes a double acting diaphragm pumping apparatus, each pumping component including a pair of spaced apart diaphragms defining a containment chamber and having all exposed surfaces in the pumping chamber and the containment chamber made of a chemically inert material, a fluid sensor extending into each containment chamber for sensing the presence of unwanted fluids therein, and a pump control system for activating the pumping apparatus and responding to an output signal generated by either sensor to deactivate the pumping apparatus in the event of leakage of fluid into either containment chamber.

An important advantage of the present invention is that in the event of primary diaphragm failure, leakage into the adjacent containment chamber will be immediately detected and the pumping system will be shut down. Another advantage of the present invention is that even in the event of failure of a primary diaphragm fluid leaking through the diaphragm will not engage any contaminating surface.

These and other objects and advantages of the present invention will no doubt become apparent to those of ordinary skill in the art after having read the following detailed description of a preferred embodiment which is illustrated in the several figures in the drawing.

IN THE DRAWING

DETAILED DESCRIPTION OF THE PREFERRED EMBODIMENT

Figure 1:
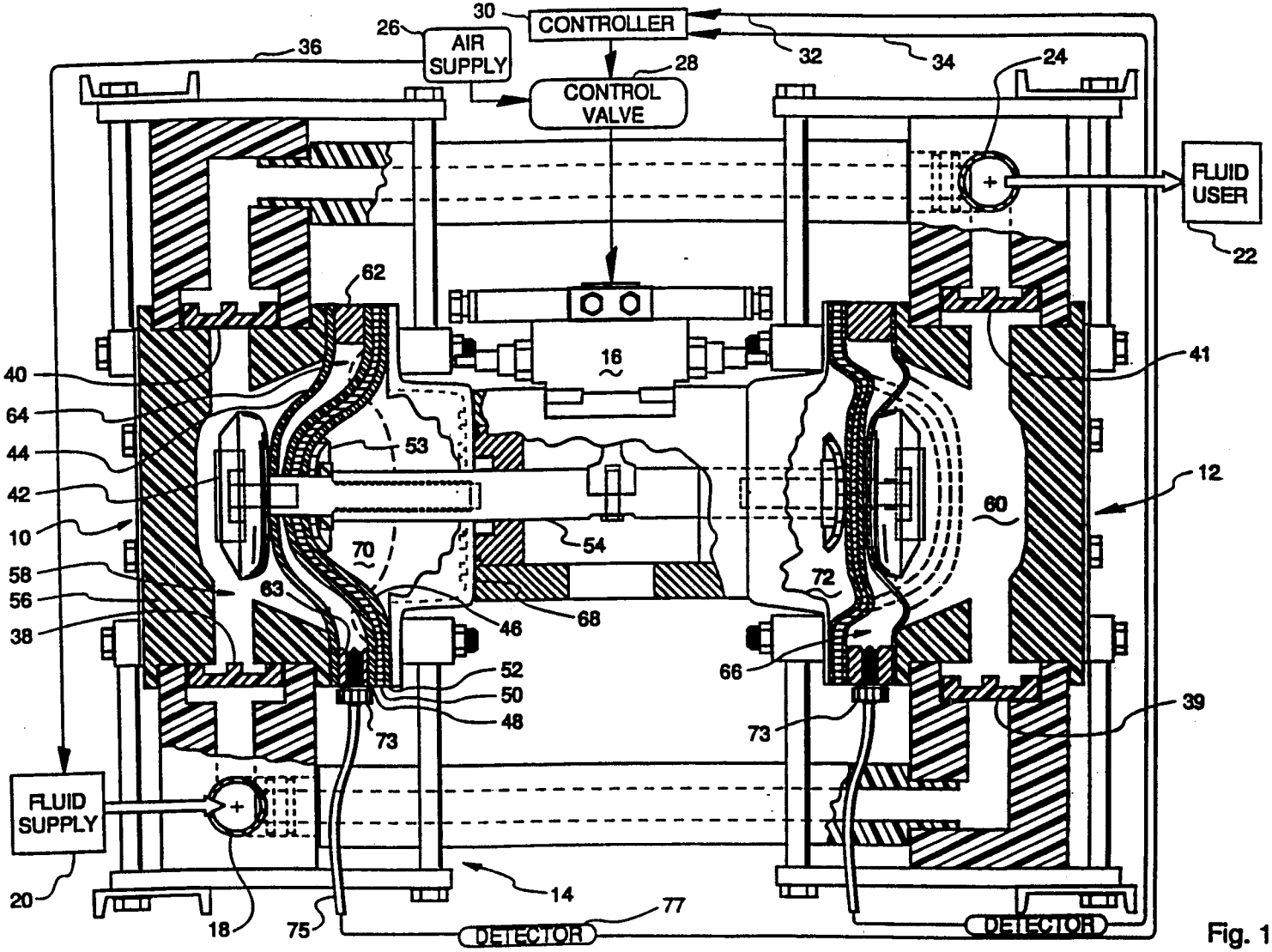
FIG. 1 is a partially broken side elevation illustrating a double acting pumping apparatus and flow control system in accordance with the present invention.

Referring now to FIG. 1 of the drawing, a double acting fluid pump apparatus and control system in accordance with the present invention is shown including a first pumping component 10, a second pumping component 12, a pump support chassis 14 and associated interconnecting conduit structures, and an activating air control subassembly 16. Fluid is input to the pump inlet 18 from a fluid supply 20 and is output to a fluid user 22 through the outlet 24. Operation of the pump or pumping device is automatically effectuated by subassembly 16 in response to pressurized air fed to it from an air supply 26 via a control valve assembly 28. Valve assembly 28 is controlled by a system controller 30 which, in addition to external inputs, responds to leak detection signals input on lines 32 and 34. Controller 30 may also output signals on line 36 for activating or deactivating the fluid supply 20.

The pumping components 10 and 12 are identically configured units, each including an inlet check valve 38 (39), an outlet check valve 40 (41), a hub and plug assembly 42, a primary diaphragm 44, a secondary diaphragm assembly 46 including a secondary diaphragm 48, a diaphragm stiffener 50 and a backing member 52. To evenly distribute translational forces to the diaphragms, inner plates 53 are also provided. The hub assemblies and diaphragm members are attached to opposite ends of a shaft 54 by suitable bolts and flanges so that the operational sequence of pumping component 10 is always 180 degrees out of phase with pumping component 12.

It will be noted that the housings 56 combine with the primary diaphragms 44 to define pumping chambers 58 and 60, and the diaphragms 44 and 48 combine with spacer rings 62 to define containment chambers 64 and 66. In addition, the housing back plates 68 combine with the backing members 52 to define actuating chambers 70 and 72 respectively.

In the preferred embodiment, all rigid parts forming surfaces contacted by the pumped fluid are made of, or are surface coated with, polyflouroaloxyl (PFA) or polytetraflouroethylene (PTFE), or other suitable inert material. The diaphragms 44 and 48, and backing members 52 are made of Teflon ®, and the diaphragm stiffeners 50 are made of Viton ®. Furthermore, care is taken to insure that the secondary diaphragm 48 is either well sealed to shaft 54 at its central opening or that the perimeter of such opening is sealed (through the central opening in stiffener 50) to the perimeter of backing member 52 so that in the event of a primary diaphragm rupture, fluid entering chamber 64 will not come into contact with the Viton ® material.

At the bottom of each ring 62 an opening 63 is provided for receiving a suitable leak trace detector probe 73 capable of sensing any fluid intruding the associated containment chamber 64.

The leak trace detection probe 73 preferably includes an optical probe coupled to a fiber optics conductor 75 leading to an optical detector 77 and is comprised of a conically configured tip which faces the chamber 64 (66). The tip has an index of refraction and, when surrounded by air, has a high level of internal reflection; but when in contact with a liquid, assumes a materially different reflective characteristic. As a consequence, the level of light transmitted to the tip through one or more of the fibers of conductor 75 and reflected back into other receiving fibers falls below a detection threshold and a leak is signaled.

Alternatively, a suitable resistive, capacitive or other appropriate type of probe could be substituted for the optical leak trace probe presently illustrated at 73.

In the configuration illustrated, pumping component 10 is depicted commencing its intake stroke causing check valve 38 to open and check valve 40 to close so that fluid is drawn into chamber 58 through inlet 18 as the diaphragm assembly is moved rightwardly. Simultaneously, pumping component 12 is beginning its pumping stroke causing check valve 39 to close the inlet passage and check valve 41 to open allowing fluid contained in chamber 60 to be forced out of the outlet 24 to the user 22.

After the diaphragm assemblies and shaft 54 have moved fully to their rightmost position, their motion will be reversed causing check valve 39 to open and allow fluid to be drawn from supply 20 through inlet 18 and into pumping chamber 60. At the same time, inlet check valve 38 will close and outlet check valve 40 will open allowing fluid contained in pumping chamber 58 to be forced through outlet 24 to user 22. The cycle is then continuously repeated under control of subassembly 16 and the system controller 30.

Figure 2:
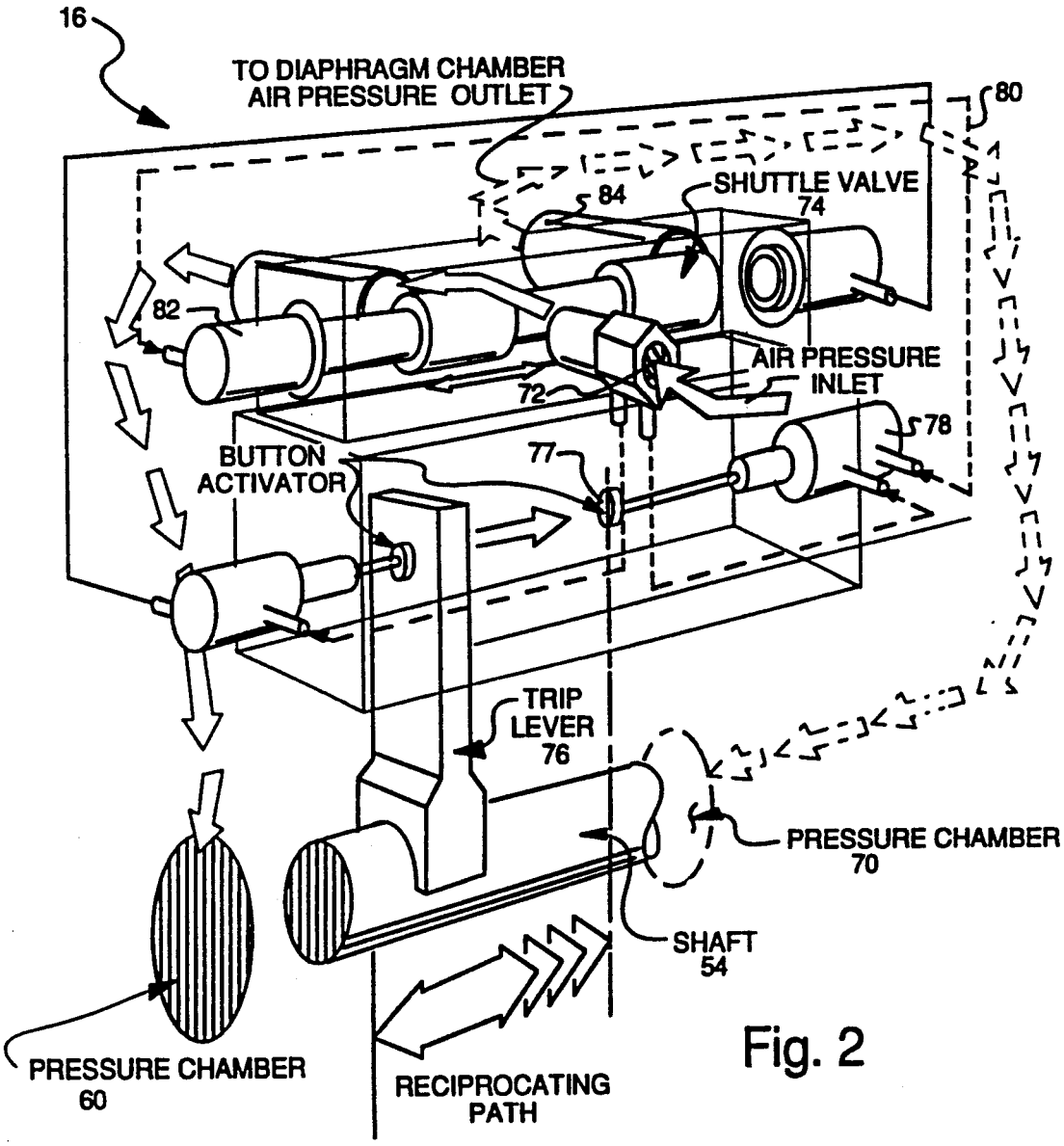
FIG. 2 is a diagram schematically illustrating the activating air supply mechanism for the pumping apparatus of FIG. 1.

Turning now to FIG. 2 of the drawing, the functional detail of the activating air subassembly 16 will be described with reference to a generalized pictorial drawing. As indicated, air pressure from air supply 26 (FIG. 1) is input at air pressure inlet 72 and is routed by a shuttle valve 74 to either pressure chamber 60 of pumping component 10 or pressure chamber 70 of pumping component 12. When air in the pressurized chamber has driven its diaphragm to its limit position, a trip lever 76 carried by shaft 54 engages a button 77 of a button air valve actuator 78 which in turn routes air from inlet 72 via air line 80 to a pneumatic shuttle valve actuator 82 which then moves the shuttle valve 74 rightwardly to transfer inlet air pressure to outlet 84 which in turn causes pressure chamber 70 to be pressurized to drive shaft 54 leftwardly, etc. Operation of such apparatus is well known to those skilled in the art.

Figure 3:
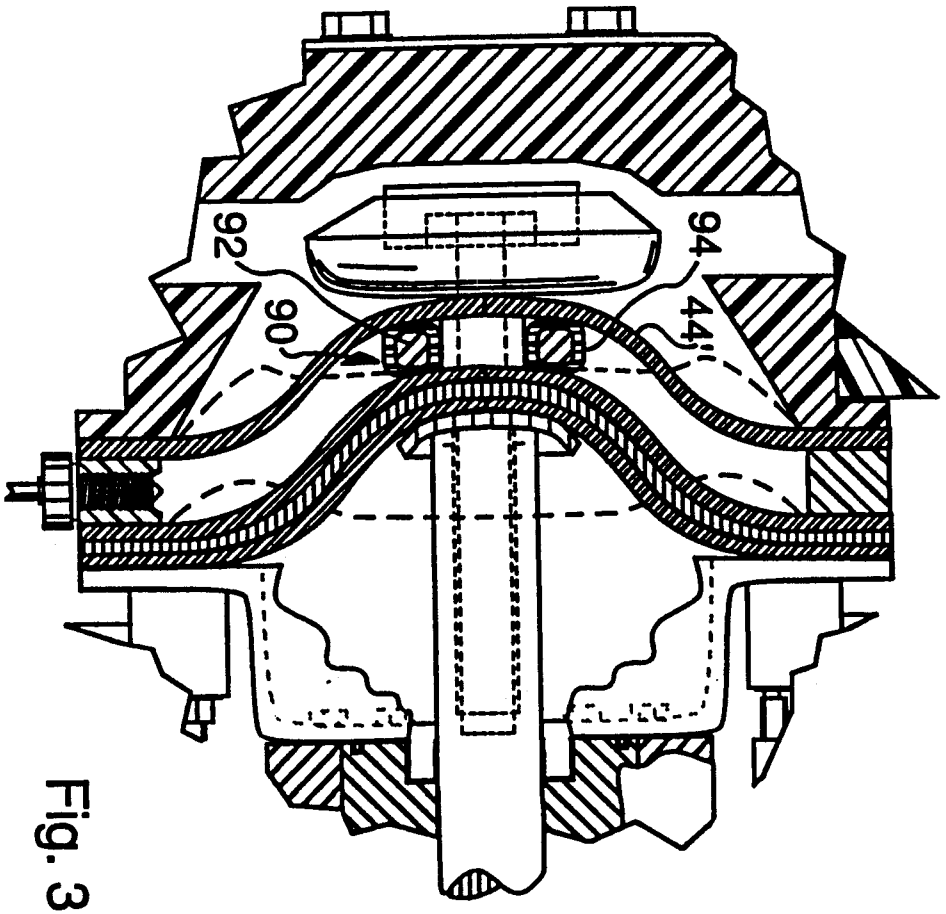
FIG. 3 is a broken partial cross-section showing an alternative diaphragm assembly in accordance with the present invention.

In an alternative embodiment illustrated in FIG. 3, a donut shaped spacer 90 is provided between primary diaphragm 44 and secondary diaphragm 46 for cushioning the application of drive forces to the primary diaphragm and making the deformation of the primary and secondary diaphragms more uniform during their translations left and right. This tends to improve the life of the diaphragms. It serves the further purpose of filling the space between the two diaphragms and reducing the leak fillable volume of the containment chamber. Spacer 90 is comprised of a core 92 of Viton material with an outer coating 94 of Teflon.

It will thus be apparent that in accordance with the present invention, a pumping system has been provided in which failure of either primary diaphragm will be immediately sensed by the sensors 73 and the corresponding signal will be transmitted to the system controller 30. In response to such signal, controller 30 will cause control valve 28 to close, thereby interrupting the air flow to the activating air switch assembly 16. Since no air will thereafter be supplied to chambers 70 or 72, the entire fluid supply line will be shut down. Controller 30 may also sound an alarm signaling the need to repair the failed diaphragm.

Moreover, since the secondary diaphragm 48 has presumably remained intact and all wetted surfaces in the containment chamber 64 (66) are inert, no contamination of the fluid flow stream can have occurred as result of the diaphragm failure. The pump can then be repaired and use of the line resumed.

Although the present invention has been described above with reference to two specific preferred embodiments, it is contemplated that other alternative features, variations and alterations thereof will become apparent to those skilled in the art. For example, for suitable applications diaphragm actuation could be accomplished electrically or hydraulically. Similarly, a pump having a single pumping component could be used. And for applications in which greater uniformity of flow velocity and pressure is required, three or more pumping components could be ganged together in a single pumping device. Accordingly, it is intended that the appended claims be interpreted as covering all such features, variations and alterations as fall within the true spirit and scope of the invention.

What is claimed is:

1. A fluid pumping apparatus for pumping ultra pure fluids and including means for detection and prevention of contamination of the fluids in the event of diaphragm failure, comprising:

means forming a pump housing having an inlet and an outlet;

a first pumping component formed within said housing and adapted to draw fluid into said inlet and to force fluid out of said outlet, said first pumping component including a first diaphragm means combining with said housing to form a first pumping chamber in communication with said inlet and said outlet, first generally annular spacer means having a first opening formed therein extending radially through one side thereof, and a second diaphragm means held in spaced apart relationship with said first diaphragm means by said spacer means and combining with said first diaphragm means and said spacer means to form a first containment chamber, said first and second diaphragm means and all interior surfaces forming said first pumping chamber and said first containment chamber being made of inert material;

first sensor means extending into said opening and having a distal end surface disposed within said first opening and forming a closure for said first containment chamber, said first sensor means being operative to detect the presence of unintended fluid appearing in said first containment chamber as a consequence of the failure of said first diaphragm means and to generate a commensurate first output signal for transmission to a remote indicator; and first actuator means for reciprocatingly moving said first diaphragm means to cause fluid to be pumped through said first pumping chamber;

the said pumping apparatus being characterized in that any failure of said first diaphragm means allowing pumped fluid to invade said first containment chamber will result in complete containment and no contamination of the invading fluid, immediate detection of the failure by said first sensor means, and annunciation of the failure by said first output signal.

2. A fluid pumping apparatus as recited in claim 1 wherein said first and second diaphragm means are made of Teflon material.

3. A fluid pumping apparatus as recited in claim 1 wherein said second diaphragm means has a resilient first stiffening member affixed to one surface thereof.

4. A first pumping apparatus as recited in claim 3 wherein said first stiffening member is covered with a layer of inert material which combines with said second diaphragm means to encapsulate said first stiffening member.

5. A fluid pumping apparatus as recited in claim 1 wherein said second diaphragm means combines with said pump housing to define a first pressure chamber to which pressurized air can be applied and withdrawn to cause said first and second diaphragm means to reciprocatingly move and cause a pumping action to occur in said first pumping chamber.

6. A fluid pumping apparatus as recited in claim 1 wherein said first actuator means includes a first pressure chamber formed between an interior wall of said housing and said second diaphragm means such that the application and withdrawal of pressurized fluid to said first pressure chamber causes said first and second diaphragm means to move reciprocatingly and cause a pumping action to occur in said first pumping chamber.

7. A fluid pumping apparatus as recited in claim 1 and further comprising cushioning means disposed within said first containment chamber to engage said first diaphragm means and distribute actuating forces more uniformly over the central position thereof.

8. A fluid pumping apparatus as recited in claim 1 and further comprising a second pumping component formed within said housing and adapted to draw fluid into said inlet and to force fluid out of said outlet, said second pumping component including a third diaphragm means combining with said housing to form a second pumping chamber in communication with said inlet and said outlet, second generally annular spacer means having a second opening formed therein extending radially through one side thereof, and a fourth diaphragm means held in spaced apart relationship with said third diaphragm means by said spacer means and combining with said third diaphragm means and said second spacer means to form a second containment chamber, said third and fourth diaphragm means and all interior surfaces forming said second pumping chamber and said second containment chamber being made of inert material;

a second sensor means extending into said second opening and having a distal end surface disposed within said second opening and forming a closure for said second containment chamber, said second sensor means being operative to detect the presence of unintended fluid appearing in said second containment chamber as a consequence of the failure of said second diaphragm means and to generate a commensurate second signal for transmission to a remote indicator; and second actuator means for reciprocatingly moving said third diaphragm means to cause fluid to be pumped through said second pumping chamber;

the said pumping apparatus being further characterized in that any failure of said third diaphragm means allowing pumped fluid to invade said second containment chamber will result in complete containment and no contamination of the invading fluid, immediate detection of the failure by said second sensor means, and annunciation of the failure by said second output signal.

9. A fluid pumping apparatus as recited in claim 8 and further comprising means rigidly connecting said first diaphragm means to said third diaphragm means and means coupled thereto for causing said first and second actuator means to operate in an antiphase relationship.

10. A fluid pumping apparatus as recited in claim 9 wherein said first, second, third and fourth diaphragm means are made of Teflon material.

11. A fluid pumping apparatus as recited in claim 8 wherein said second and fourth diaphragm means have resilient stiffening members affixed to surfaces thereof.

12. A fluid pumping apparatus as recited in claim 11 wherein said stiffening members are each covered with a layer of inert material which combines with the associated diaphragm means so that said stiffening members are encapsulated thereby.

13. A fluid pumping apparatus as recited in claim 9 wherein said second and fourth diaphragm means combine with said pump housing to define first and second pressure chambers to which pressurized air can be applied and withdrawn to cause said first and third diaphragm means to reciprocatingly move and cause a pumping action to occur in said first and second pumping chambers.

14. A fluid pumping apparatus as recited in claim 9 wherein said first and second actuator means include first and second pressure chambers formed respectively between interior walls of said housing and said second and fourth diaphragm means such that the application and withdrawal of pressurized fluid to each said pressure chamber causes said first and third diaphragm means to move reciprocatingly to cause pumping action to occur in each said pumping chamber.

15. A fluid pumping apparatus as recited in claim 1 and further comprising control means responsive to said first output signal and operative to prevent said first actuator means from moving said first diaphragm means in the event a failure of said first diaphragm means is detected.

16. A fluid pumping apparatus as recited in claim 8 and further comprising control means responsive to said first and second output signals and operative to disable said first first and second actuator means in the event a breach of either said first or third diaphragm means is detected.

17. A fluid pumping apparatus as recited in claim 1 wherein said first sensor means includes an optical probe disposed within said first opening and optically connected to a remote detector means.

18. A fluid pumping apparatus as recited in claim 8 wherein said first and second sensor means each include an optical probe disposed within a corresponding opening and optically connected to a remote detector means.

* * * * *